United States Patent [19]

Gaynor

[11] Patent Number: 4,999,597

[45] Date of Patent: Mar. 12, 1991

[54] BIFILAR PLANAR INDUCTOR

[75] Inventor: Michael P. Gaynor, Oak Park, Ill.

[73] Assignee: Motorola, Inc., Schaumburg, Ill.

[21] Appl. No.: 481,002

[22] Filed: Feb. 16, 1990

[51] Int. Cl.[5] ..... H01P 1/00; H01F 27/28

[52] U.S. Cl. ..... 333/246; 336/200; 336/232

[58] Field of Search ..... 336/200, 232, 180, 182, 336/225, 220; 333/246, 238, 161, 204, 205, 104

[56] References Cited

U.S. PATENT DOCUMENTS

| | | | |
|---|---|---|---|
| 2,611,010 | 9/1952 | Sass et al. | 336/200 X |
| 2,786,984 | 3/1957 | Slate | 336/200 X |
| 2,843,829 | 7/1958 | Slate | 336/232 X |
| 2,900,612 | 8/1959 | Tripp | 336/200 X |
| 4,012,703 | 3/1977 | Chamberlayne | 336/200 X |
| 4,253,079 | 2/1981 | Brosh | 336/200 X |
| 4,494,100 | 1/1985 | Stengel et al. | 336/200 |

FOREIGN PATENT DOCUMENTS 2230587 4/1980 Fed. Rep. of Germany ..... 336/200

OTHER PUBLICATIONS

"Etched Transformer", Crawford et al, IBM Technical Disclosure Bulletin, vol. 8, No. 5, Oct. 1965, p. 723.

*Primary Examiner*—Thomas J. Kozma

*Attorney, Agent, or Firm*—Joseph P. Krause

[57] ABSTRACT

A planar microstrip inductor formed from a spiral shaped conductive path of material on a dielectric uses a bifilar spiral by which both the connection nodes of the inductor can be brought out to the edge of the substrate. The bifilar winding by which both connection nodes are available from the exterior of the spiral shape includes the use of a jumper wire to connect the inner node of the inductor to a circuit.

8 Claims, 1 Drawing Sheet

BIFILAR PLANAR INDUCTOR

BACKGROUND OF THE INVENTION

This invention relates to inductors. In particular, this invention relates to planar microstrip inductors.

Microstrip inductors are typically planar conductive materials deposited onto a dielectric substrate providing a fixed amount of inductance for an electronic circuit. As is well known in the art, any length of conductive material or metal will inherently include some amount of inductance and increasing the length of a conductor and/or changing the physical configuration of a conductor can increase the inductance provided by an inductor in a reduced space.

For example, winding a piece of wire, having some nominal amount of inductance when it is a linear conductor, around another material (air, a dielectric, or metal, for example) can increase the inductance of wire substantially. Microstrip conductors frequently wind a planar conductor deposited on to a substrate in a spiral pattern to increase the inductance between the terminals of the planar conductor as well. (It is also known that changing the physical dimensions of a planar conductor on a substrate will also affect its inductance.)

Some prior art microstrip inductors employ planar conductive materials on a substrate which spiral in inwardly (or outwardly) on a dielectric substrate providing an increased amount of inductance at the terminals of the planar material. When a conductive material, such as a metal, is deposited onto a planar substrate with a spiral orientation, the prior art required that the connection node at the inner focus of the spiral be made accessible by means of a jumper wire physically bridging the windings of the spiral. This jumper wire to the inside of the spiral was known to break, change the desired value of the inductance of the spiral somewhat unpredictably, and increase the manufacturing cost requiring manual connection of the jumper lead to the spiral in many applications. A microstrip inductor that precludes the use of a jumper wire to connect a spiral microstrip inductor at both ends would be an improvement over the prior art.

SUMMARY OF THE INVENTION

The invention disclosed herein is a planar microstrip inductor formed on a substantially planar dielectric substrate onto which is deposited a continuous path of conductive material. The conductive material deposited onto a substrate is deposited with a bifilar pattern by which both the ends of the inductor formed by the conductive material on the substrate are accessible from the outside edge of the substrate. (A bifilar winding is a winding composed of a single path of material doubled back upon itself.)

The microstrip inductor on the substrate usually includes a conductive ground plane deposited onto the opposite side of the dielectric. It might also include a second dielectric covering the bifilar winding forming a so called strip line inductor.

The preferred embodiment employed a rectangular substrate and a rectangularly oriented shapes for the conductive path.

DETAILED DESCRIPTION OF THE PREFERRED EMBODIMENT

Figure 1:
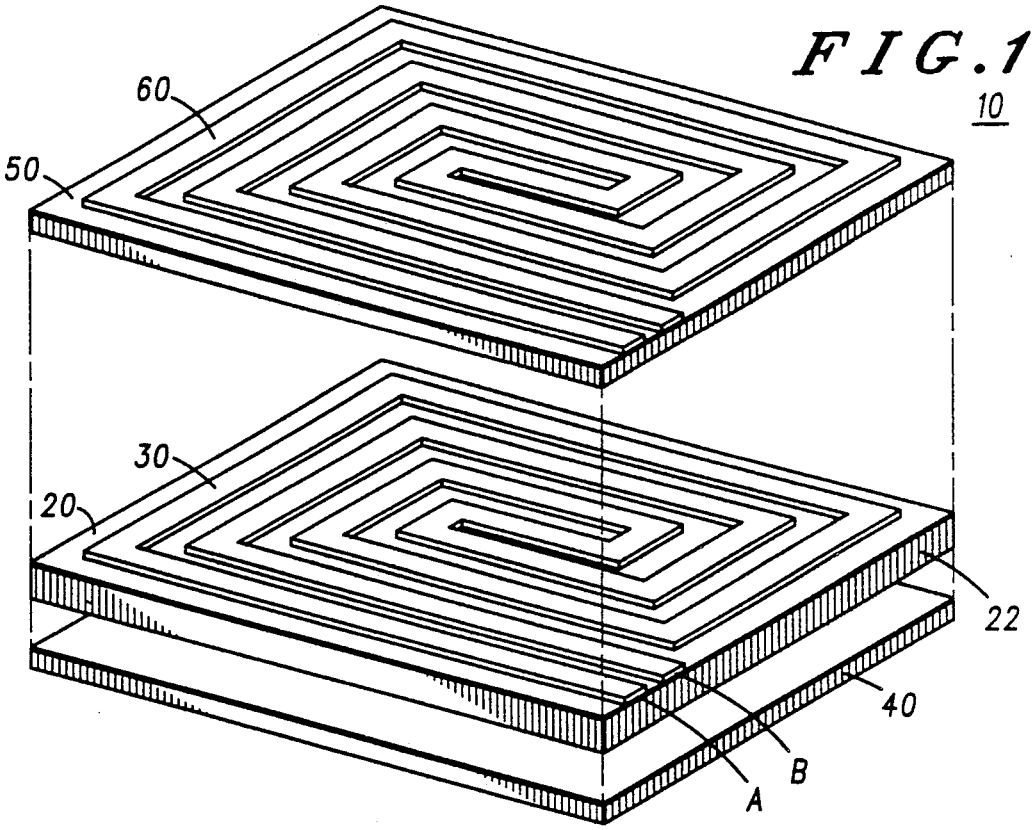
FIG. 1 shows a perspective view of the microstrip inductor.

FIG. 1 shows an exploded, isometric view of the microstrip inductor (10). The inductor (10) is constructed from a dielectric substrate (20) onto which is deposited a continuous path of conductive material (30). The path has two conection nodes or ends (A and B) which are located proximate to the edge of the dielectric substrate (20). (The edge of the dielectric (20) can be readily seen in FIG. 2 and is denoted as item 22). The dielectric substrate (20) is preferably a ceramic material, however alternate embodiements of the invention would include using teflon, polyimide, or glass, for the substrate (20). The physical dimensions of the substrate (20) including its length and width in the case of a rectangular substrate (20), would of course change for differenct applications. Similarly, the thickness of the dielectric might also change according to the application intended for the device.

The microstrip inductor (10) as shown in FIG. 1, will typically include a second conductive plane (40) as shown. The second plane (40) is deposited on the second or underside of the substrate (20) and usually acts as a ground plane, degrading the inductance but removing any discontinuities in the ground plane of the bifilarly patterned material (30) on the first side of the substrate (20).

While the bifilarly patterned inductor (30) and the conductive plane (40) can be any type of conductive material, the patterned material (30) as well as the second conductive plane (40) is typically metallic. Materials such as copper, gold, silver, or the like are most widely used. Other materials might be used as well including possibly the use of certain superconducting materials such as YBC.

Figure 2:
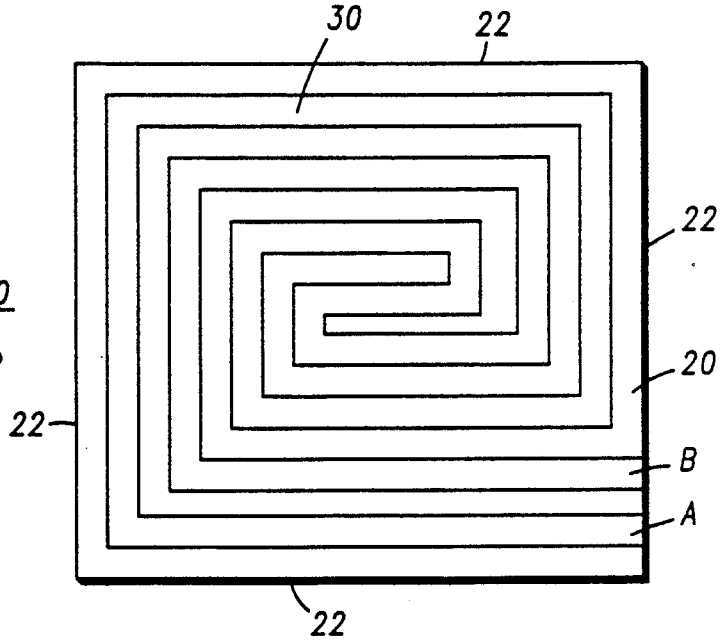
FIG. 2 shows a top view of a microstrip inductor.

If a second dielectric substrate (50) covers the bifilar patterned inductor (30), a transformer may be formed by the addition of a second planar inductor onto the second dielectric substrate (50). One bifilar inductor (30) might be considered the primary winding; the other bifilar inductor (60) would therefore be the secondary winding. The second planar inductor might also have a bifilar pattern. (If instead of adding a second planar inductor to the second dielectric, a second ground plane on the second dielectric and above the bifilar pattern is added and is accompanied by the first ground plane, a stripline inductor is formed.) As shown in FIG. 2, the geometric shape of the substrate (20) as well as the shape of the bifilarly wound path (30) is rectangular. The two connection ends (A and B) of the bifilarly wound conductive path (30) are both accessible at the wounding edge (22) as shown. A principle advantage of the bifilar winding of the inductor is that both the connection nodes (A and B) can be proximately located to the bounding edge (22) as shown.

Figure 3:
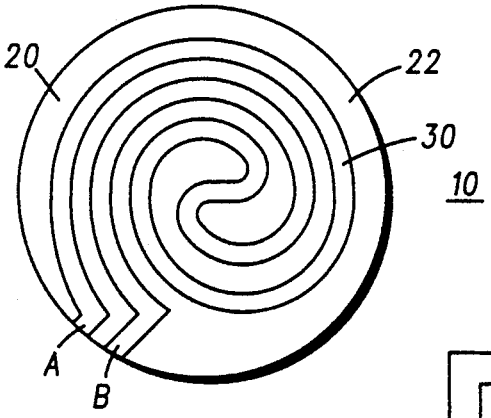
FIG. 3 shows the microstrip inductor with an alternate embodiment with an alternate geometric pattern, for the substrate and conductive path.

FIG. 3 shows an alternate geometric pattern for both the substrate (20) and the bifilarly wound inductor (30). In this figure both the substrate (20) and the conductor path (30) are circularly orientated. As shown in FIG. 2 the single bounding edge (22) is also circular. The connection ends (A and B) are also both approximately located to the bounding edge (22). Those skilled in the art will recognize that alternate embodiments would include the use of rectangular substrates with circular inductors and vice versa.

In the preferred embodiment the conductive path (30) was a copper material, painted onto the ceramic substrate. The copper was approximately 1/1000 of an inch (0.0254 mm.) thick. Adjusting that thickness will of course adjust the inductance of the device. The ceramic was approximately 35/1000 of an inch (0.889 mm.) thick.

What is claimed is:

1. A substantially planar stripline inductor comprised of:

first dielectric substrate means for supporting conductive material, said dielectric substrate means being substantially planar with first and second sides and with at least one bounding edge;

a first continuous path of conductive material deposited onto said first side of said first dielectric means, said path having at least first and second ends and having a bifilar pattern by which said at least first and second ends form connection nodes proximate to said bounding edge(.);

a first conductive plane deposited onto said second side of said substrate means;

a second dielectric substrate deposited onto said first substrate means, substantially covering said first continuous path; and a second conductive plane deposited onto said second dielectric layer thereby forming a strip line inductor.

2. The stripline inductor of claim 1 wherein said bifilar pattern has a substantially circular orientation.

3. The stripline inductor of claim 1 wherein said bifilar pattern has a substantially rectangular orientation.

4. The stripline inductor of claim 1 wherein said dielectric substrate means is ceramic.

5. The microstrip inductor of claim 1 wherein said dielectric substrate means is teflon.

6. The stripline inductor of claim 1 wherein said dielectric substrate means is polyimide.

7. The stripline inductor of claim 1 wherein said dielectric substrate means is substantially circular.

8. The stripline inductor of claim 1 wherein said dielectric substrate means in rectangular.

* * * * *